US007428879B1

(12) United States Patent
White et al.

(10) Patent No.: US 7,428,879 B1
(45) Date of Patent: Sep. 30, 2008

(54) TOWER FLAG ACTUATOR

(76) Inventors: Gregory A. White, 3656 Highland Dr., Carlsbad, CA (US) 92008; Dean Rohan, 421 Lexington Cir., Oceanside, CA (US) 92057; Axel F. Mnich, 3038 Industry St., Suite 108, Oceanside, CA (US) 92054

( * ) Notice: Subject to any disclaimer, the term of this patent is extended or adjusted under 35 U.S.C. 154(b) by 0 days.

(21) Appl. No.: 11/841,528

(22) Filed: Aug. 20, 2007

(51) Int. Cl.
*G01D 13/22* (2006.01)
*B63B 21/04* (2006.01)

(52) U.S. Cl. ..... 116/303; 116/173; 114/253

(58) Field of Classification Search ..... 116/303, 116/305, 313, 284, 285, 294, 209, 173, 174; 114/253, 343; 441/69
See application file for complete search history.

(56) References Cited

U.S. PATENT DOCUMENTS 2,944,507 A * 7/1960 Beal ..... 114/253
3,034,470 A * 5/1962 Vanderfeltz et al. ..... 114/218
3,602,188 A * 8/1971 Penaflor ..... 116/324
3,848,244 A * 11/1974 Young et al. ..... 340/665
3,919,963 A * 11/1975 Cox, III ..... 114/253
4,640,213 A * 2/1987 Lugo ..... 114/253
4,782,784 A * 11/1988 Little ..... 116/303
4,807,557 A * 2/1989 Lodisio ..... 116/173
5,550,531 A * 8/1996 Little-Lowry ..... 340/573.6
5,771,836 A * 6/1998 Crouse ..... 116/209
5,979,350 A * 11/1999 Larson et al. ..... 114/253
6,962,126 B1 * 11/2005 Payson ..... 116/303
7,013,823 B1 * 3/2006 Daugherty ..... 114/253

* cited by examiner

*Primary Examiner*—R. A. Smith
*Assistant Examiner*—Amy Cohen Johnson
(74) *Attorney, Agent, or Firm*—Nydegger & Associates

(57) ABSTRACT

A safety device automatically raises and lowers a warning flag over a boat based on the tension applied to a line towed by the boat. For the device, the tow line is anchored to a tower mounted on the boat. Further, an arm is pivotably connected to the tower for movement between first and second orientations. Structurally, the arm is partially enclosed within a housing mounted to the tower. Also, the warning flag is pivotably mounted to the housing. Within the housing, the device includes a mechanism for translating movement of the arm to movement of the flag between raised and lowered orientations. When the tow line is slack, the arm is biased toward the first orientation by a spring. However, when the line becomes taut, the tension in the line overcomes the spring force and the arm is moved to its second orientation.

18 Claims, 2 Drawing Sheets

TOWER FLAG ACTUATOR

FIELD OF THE INVENTION

The present invention pertains generally to water sports safety devices. More particularly, the present invention pertains to safety devices for a boat that will indicate when a wake boarder or water skier from the boat is submerged in the water. The present invention is particularly, but not exclusively, useful as a system and method for automatically raising and lowering a warning flag over a boat when there has been a predetermined change in the tension from the boat's tow line.

BACKGROUND OF THE INVENTION

With the growth in popularity of water sports and the limited areas suitable for water sports, there has been a dramatic increase in the number of participants at any one water sports area. As a result, this increase has caused safety concerns. For instance, during a busy day, a lake may have a number of water vessels in close proximity. These vessels may be used for wake boarding, water skiing, fishing, sailing, or general boating. Further, the vessels can vary in size from large yachts to small, jet-powered personal water craft.

In view of the number of vessels on a particular body of water, as well as the varied experience levels of their operators, safety is a great concern. While the vessels themselves provide some protection, people in the water are in increased danger due to their exposure, their inability to move quickly and their reduced visual impact on others. Fallen wake boarders and water skiers are in particular danger during the time it takes for their vessels to recognize the fall and to circle back around to pick them up.

In light of the above, it is an object of the present invention to provide a device and method for automatically raising a warning flag over a boat to indicate that a person is in the water near the boat. Another object of the present invention is to provide a device and method for automatically raising a warning flag when a tow line from a boat goes slack. Yet another object of the present invention is to provide a device and method for automatically lowering a warning flag over a boat when a tow line becomes taut. Still another object of the present invention is to provide a device and method for automatically raising and lowering a warning flag over a boat that is easy to use and install, that is simple to operate and that is cost effective.

SUMMARY OF THE INVENTION

In accordance with the present invention, a safety device automatically raises and lowers a warning flag over a boat based on the tension provided from a tow line. Specifically, the device raises the flag when the tow line is slack and lowers the flag when the tow line is taut. Typically, the device is provided for use with a boat having a tower and cross bar for anchoring the tow line.

Structurally, the device includes a pair of arms that are pivotably connected to the cross bar for movement between a first orientation and a second orientation. In order to connect the arm and cross bar, each arm forms a hole that receives the cross bar. Further, each arm is provided with a housing that is mounted to the cross bar. Structurally, each housing defines an internal cavity in which each respective arm is partially positioned. Also positioned in each housing are three interconnected links. For purposes of the present invention, the first link interconnects the housing and the second link. The second link, in turn, interconnects the first link and the third link. Further, the third link interconnects the second link and the warning flag. Importantly, the arm itself is connected to the junction of the second link and third link. Also, the arm contacts the junction of the first link and second link. As a result of these connections, pivotable movement of the arm is communicated to the warning flag and causes the warning flag to be raised or lowered.

For connection with the tow line, the device is provided with a lever rod that extends between the arms. Specifically, the lever rod is connected to the distal end of each arm. Further, the lever rod includes a straight portion and a curved portion that form an opening. With this construction, the curved portion of the lever rod is pivotable about the straight portion to be selectively positioned to intercept, contact and resist the tow line. Due to the interaction between the tow line and the curved portion of the lever rod, tension in the tow line is communicated to the arms to pivot the arms about the cross bar.

In order to bias the flag toward a raised orientation, an expansion spring is interconnected between each arm and the respective housing. The spring biases each arm toward its first orientation. When each arm is in its first orientation, the interconnection between the links requires the flag be in its raised orientation. However, during use of the tow line in wake boarding or water skiing, the tow line becomes taut and forces the arms to rotate about the cross bar to their second orientation against the force of the spring. As a result, the links cause the flag to move from the raised orientation to the lowered orientation. When the tow line is dropped or otherwise becomes slack, the spring force then moves the arms back to their first orientation and the flag is raised.

BRIEF DESCRIPTION OF THE DRAWINGS

The novel features of this invention, as well as the invention itself, both as to its structure and its operation, will be best understood from the accompanying drawings, taken in conjunction with the accompanying description, in which similar reference characters refer to similar parts, and in which.

DESCRIPTION OF THE PREFERRED EMBODIMENTS

Figure 1:
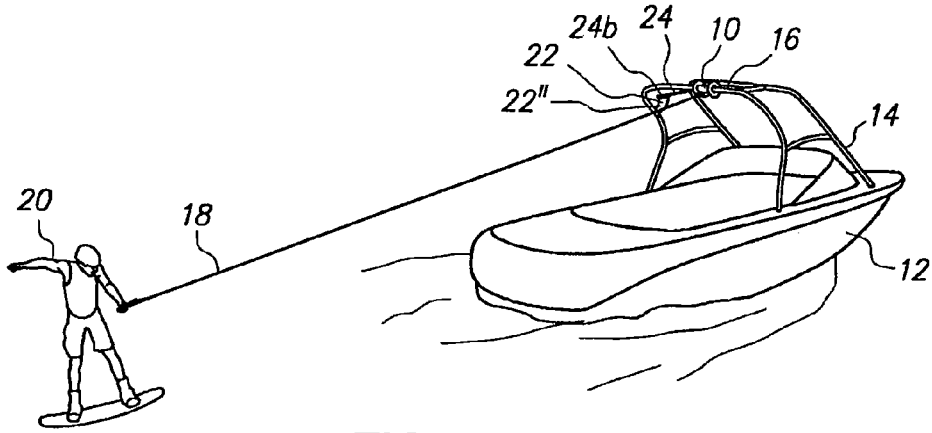
FIG. 1 is a perspective view of a wakeboarder being towed by a boat outfitted with the safety device of the present invention.

Referring initially to FIG. 1, a safety device in accordance with the present invention is shown and is designated 10. As shown, the device 10 is mounted on a boat 12. Structurally, the boat 12 includes a tower 14 that has a cross bar 16. In FIG. 1, the device 10 is mounted on the cross bar 16. As shown, a tow line 18 used to pull a wake boarder 20 is also anchored to the cross bar 16. In FIG. 1, the tow line 18 is taut. As a result of the tautness of the tow line 18, the warning flag 22, attached to the distal end 24*b* of a flag mount 24, is in a lowered orientation 22".

Figure 2:
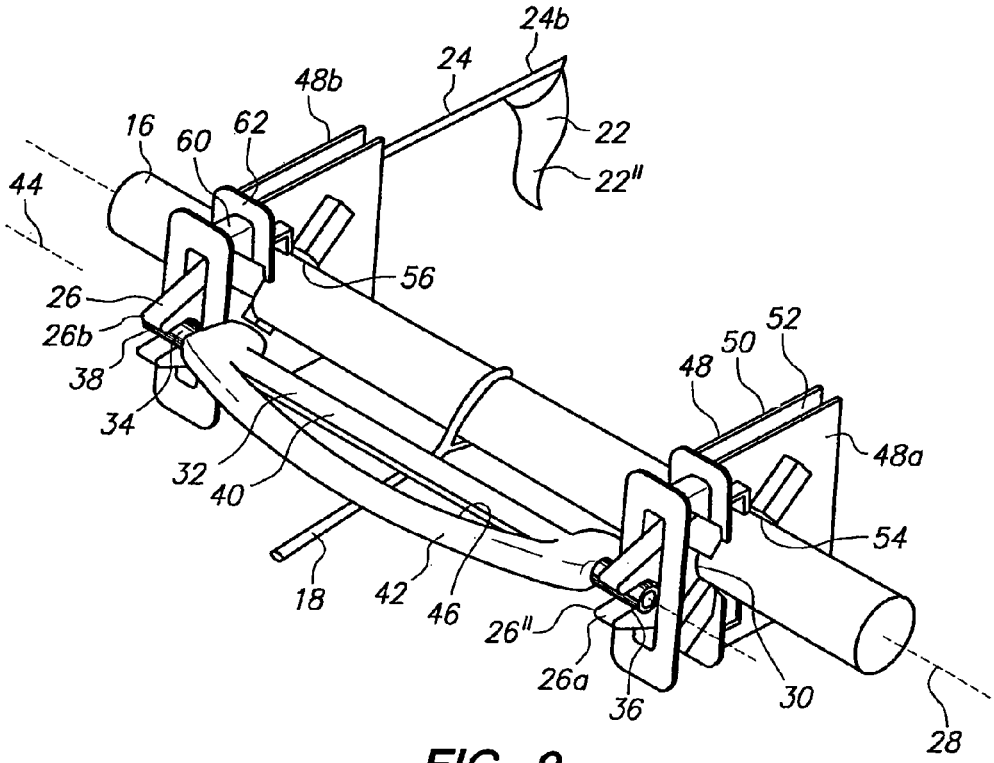
FIG. 2 is a perspective view of the safety device mounted on the boat for automatically raising a warning flag over a boat when a tow line attached to the boat goes slack.

In FIG. 2, the lowered orientation 22" of the warning flag 22 is clearly illustrated. Further, the connection between the device 10 and the cross bar 16 is more clearly shown. For purposes of the present invention, the device 10 includes a pair of arms 26*a*, 26*b* that are pivotably connected to the cross bar 16. Specifically, the cross bar 16 defines a cross bar axis 28 about which the arms 26 may pivot. Structurally, each arm 26 forms a hole 30 which receives the cross bar 16. While the arms 26 have a first orientation (not shown), they are in a second orientation 26" in FIG. 2 due to the tautness of the tow line 18 as explained below.

As shown in FIG. 2, the device 10 includes a lever rod 32 that interconnects the arms 26. More specifically, each arm 26 has a distal end 34 that forms a ribbed notch 36 distanced from the cross bar 16. In FIG. 2, the ribbed notches 36 are engaged by the ribbed ends 38 of the lever rod 32 to interconnect the arms 26. Structurally, the lever rod 32 includes a straight portion 40 and a curved portion 42. As shown, the straight portion 40 defines a lever axis 44 that is substantially parallel to the cross bar axis 28. Further, the straight portion 40 and the curved portion 42 enclose an opening 46. Typically, when the tow line 18 is slack, the curved portion 42 of the lever rod 32 hangs downwardly toward the boat 12. With this construction, the tow line 18 must engage the curved portion 42 of the lever rod 32 when the tow line 18 becomes taut.

As further shown in FIG. 2, the device 10 includes a pair of housings 48*a*, 48*b* that are mounted to the cross bar 16. Cross-referencing FIGS. 2 and 3, each housing 48 is formed by a pair of parallel plates 50 defining an internal cavity 52 that receives a respective arm 26. Further, each pair of plates 50 forms an aperture 54 that receives the cross bar 16. In order to engage the cross bar 16, the plates 50 on each housing 48 are provided with a plurality of threaded channels 56. Further, each housing 48 is provided with a plurality of threaded engagement members 58 that are selectively positioned in the channels 56. Specifically, the engagement members 58 may be extended or retracted radially from the cross bar axis 28 in order to engage cross bars 16 having different diameters. When proper engagement between the engagement members 58 and the cross bar 16 is attained, the engagement members 58 are locked in position by frictional interaction with the threaded channels 56.

Figure 3:
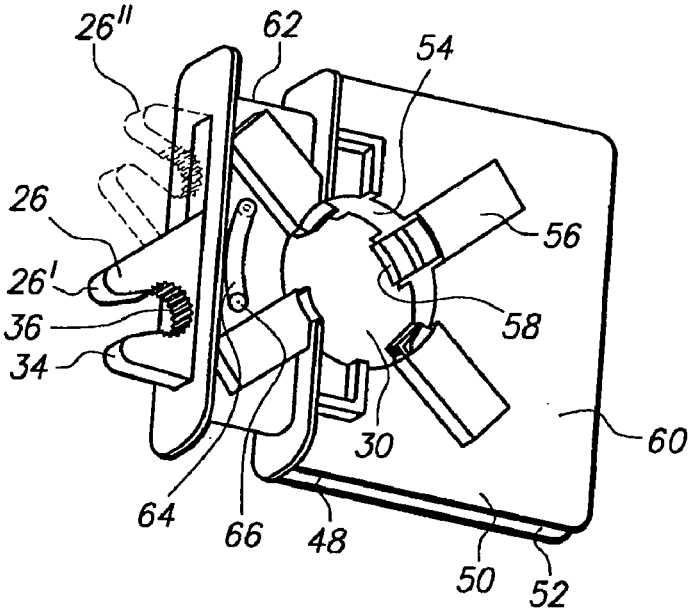
FIG. 3 is a perspective view of the safety device illustrating the first and second orientations of the device's arm.

Still referring to FIGS. 2 and 3, each housing 48 has an external surface 60 that forms a spool 62 for winding up the tow line 18 when not in use. In FIG. 3, it can be seen that a slot 64 is formed on the external surface 60. Further, a pin 66 connected to each arm 26 extends through the slot 64 to allow for physical manipulation of the orientation of the arm 26. Specifically, the pin 66 allows the arm 26 to be manually moved between the first orientation 26' and the second orientation 26" (shown in phantom) when the tow line 18 is not taut. This allows the flag 22 to be lowered when the tow line 18 is slack and no wake boarders 20 or skiers are in the water.

Figure 4:
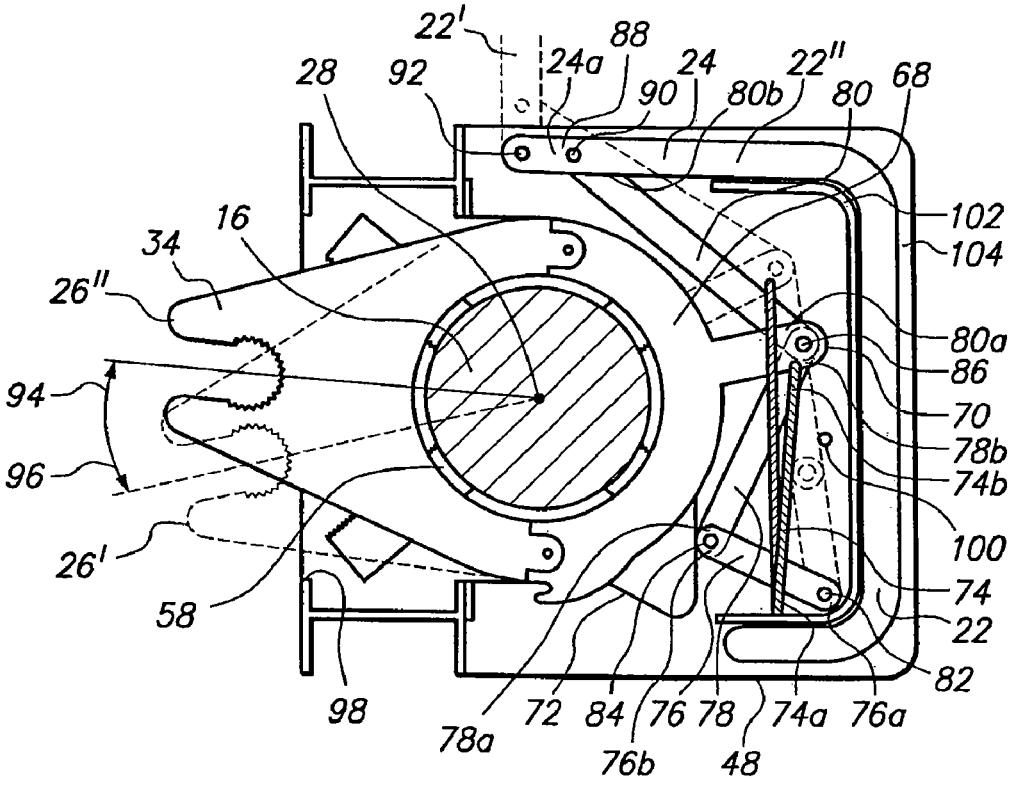
FIG. 4 is a plan view of the internal components of the safety device illustrating the movement of the internal components between the first and second orientations of the arm.

Referring now to FIG. 4, the internal components of the device 10 may be understood. As shown, each arm 26 includes a proximal end 68 having a tab 70 and a cam 72 that extend radially from the cross bar axis 28. Further, the tab 70 is engaged by a spring 74 that is interconnected with the housing 48. Specifically, the spring 74 is biased to expand so that the tab 70 and the distal end 74*b* of the spring 74 are biased away from the proximal end 74*a* of the spring 74. As a result, the arms 26 are biased toward their first orientation 26' (shown in phantom) by the spring 74.

In FIG. 4, it can be seen that the device 10 includes three links 76, 78, and 80 which interconnect the housing 48, the arm 26 and the flag mount 24. Specifically, the first link 76 has a proximal end 76*a* that is pivotably mounted to the housing 48 by a pin 82. As shown, the distal end 76*b* of the first link 76 is pivotably connected to the proximal end 78*a* of the second link 78 by a second pin 84. Further, the distal end 78*b* of the second link 78 is pivotably connected both to the tab 70 of the arm 26 and to the proximal end 80*a* of the third link 80 by a pin 86. Finally, the distal end 80*b* of the third link 80 is pivotably connected to the flag mount 24 at a location 88 by a pin 90. Also, the proximal end 24*a* of the flag mount 24 is shown pivotably connected to the housing 48 by a pin 92.

With this understanding of the structural interconnection between the housing 48, flag mount 24, arm 26, the relation between the raised and lowered orientations 22', 22" of the warning flag 22 and the first and second orientations 26', 26" of the arms 26 can be explained. As shown in phantom in FIG. 4, the arm 26 is biased to its first orientation 26' by expansion of the spring 74. As a result, the third link 80 pushes the flag mount 24 to pivot about the pin 92 so that the flag 22 is in its raised orientation 22'.

When the tow line 18 is pulled taut, it engages the lever rod 32 (shown in FIGS. 1-2) and causes the lever rod 32 to pivot about the cross bar axis 28 away from the boat 12 in the direction of arrow 94. As a result, the distal ends 34 of the arms 26 are pushed away from the boat 12 and the arms 26 pivot about the cross bar axis 28 (clockwise in the illustration of FIG. 4). As each arm 26 pivots, the cam 72 moves out of the path of the distal end 76*b* of the first link 76 and the proximal end 78*a* of the second link 78. At the same time, the tab 70 contracts the spring 74 and pushes the distal end 78*b* of the second link 78 toward the proximal end 76*a* of the first link 76. Further, the tab 70 pulls the proximal end 80*a* of the third link 80 away from the distal end 80*b*. As a result, the flag mount 24 is pivoted about the pin 92 by the distal end 80*b* of the third link 80 until the flag 22 is in its lowered orientation 22".

When the tow line 18 is dropped by the wake boarder 20 (shown in FIG. 1), it loosens its engagement with the lever rod 32 (shown in FIGS. 1-3). Accordingly, when the force of expansion of the spring 74 overcomes the force exerted on the lever rod 32 by the tow line 18, the spring 74 causes the arm 26 to pivot (counterclockwise in the view of FIG. 4) with the distal end 34 of the arm 26 pivoting toward the boat 12 (shown in FIG. 1) in the direction of arrow 96. As a result, the cam 72 mounted on the proximal end 68 of the arm 26 drives into the distal end 76*b* of the first link 76 and the proximal end 78*a* of the second link 78. Also, the tab 70 pulls the distal end 78*b* of the second link 78 away from the proximal end 76*a* of the first link 76 and pushes the third link 80. As a result, the third link 80 pushes the flag mount 24 to pivot about the pin 92 until the flag 22 is in its raised orientation 22'. Movement of the arm 26 in the direction of arrow 96 may be stopped when the arm 26 abuts the edge 98 of the cavity 52, or by contact between the second link 78 and a post 100 mounted on the housing 48.

As shown in FIG. 4, the housing 48 is provided with a wall 102 that protects the internal cavity 52 and the components therein. Also, the wall 102 defines a channel 104 in which the flag mount 24 and a flexible flag 22 may be stored.

Referring back to FIG. 2, adjustment of the lever rod 32 may be understood. As shown, the ribbed ends 38 of the lever rod 32 may be moved along the lever axis 44 relative to the ribbed notches of the arms 26. Further, the position of the curved portion 42 of the lever rod 32 may be angularly adjusted relative to the lever axis 44. As a result, the height of the curved portion 42, i.e., the distance between the curved portion 42 and the boat 12, may be adjusted. In this manner, wake boarders 20 of different heights, tow lines 18 of different lengths, and other conditions may be accommodated by adjustment of the lever rod 32. When a desired angular relationship of the lever rod 32 relative to the ribbed notches 36 is attained, the ribbed ends 38 of the lever rod 32 and the ribbed notches 36 of the arms 26 engage to prevent unintended relative movement.

While the particular Tower Flag Actuator as herein shown and disclosed in detail is fully capable of obtaining the objects and providing the advantages herein before stated, it is to be understood that it is merely illustrative of the presently preferred embodiments of the invention and that no limitations are intended to the details of construction or design herein shown other than as described in the appended claims.

What is claimed is:

1. A device for automatically raising a warning flag over a boat when a tow line attached to the boat goes slack, the device comprising:

a tower mounted to the boat and including a cross bar for anchoring the tow line, with the cross bar defining a cross bar axis;

an arm pivotably connected to the cross bar, with the arm forming a hole to receive the cross bar, wherein the arm is biased toward a first orientation and has a second orientation, and wherein the tow line engages the arm and pivots the arm about the cross bar axis from the first orientation to the second orientation when the tow line becomes taut;

a housing mounted to the cross bar, the housing defining an internal cavity for receiving the arm and the cross bar;

a first link having a distal end and a proximal end pivotably mounted to the housing;

a second link having a distal end and a proximal end pivotably connected to the distal end of the first link, wherein the distal end of the second link is pivotably connected to the arm;

a third link having a distal end and a proximal end pivotably connected to the arm and pivotably connected to the distal end of the second link; and a flag mount having a distal end and a proximal end pivotably mounted to the housing, wherein the flag mount has a pivot distanced from the proximal end and pivotably connected to the distal end of the third link, wherein the warning flag is connected to the distal end of the flag mount, and wherein the flag mount lowers the warning flag when the arm is in the first orientation and raises the warning flag when the arm is in the second orientation.

2. A device as recited in claim 1 wherein the arm comprises a first arm and a second arm, with each arm extending from the cross bar to a distal end forming a ribbed notch, and wherein the ribbed notches define a lever axis substantially parallel to the axis.

3. A device as recited in claim 2 further comprising a lever rod mounted in the ribbed notches to interconnect the distal ends of the arms, wherein the tow line engages the lever rod to pivot the arms about the cross bar axis from the first orientation to the second orientation when the tow line becomes taut.

4. A device as recited in claim 3 wherein the lever rod includes a straight portion coincident with the lever axis and a curved portion, with the tow line engaging the curved portion.

5. A device as recited in claim 4 wherein the lever rod is rotatably adjustable within the notches of the arms to position the curved portion of the lever rod at a selected height relative to the boat to adjust the position of the tow line.

6. A device as recited in claim 1 wherein the housing forms a plurality of threaded channels extending radially from the axis, and wherein the device further comprises a plurality of threaded engagement members positioned in the threaded channels to engage the cross bar.

7. A device as recited in claim 1 wherein the arm includes a radially-extending tab, and wherein the distal end of the second link is pivotably connected to the tab and the proximal end of the third link is pivotably connected to the tab.

8. A device as recited in claim 7 further comprising a spring having a first end mounted to the housing and a second end mounted to the tab of the arm to bias the arm to the first orientation.

9. A device as recited in claim 1 wherein the housing has an exterior surface that forms a spool for storing the tow line when not in use.

10. A device as recited in claim 1 wherein a first pin interconnects the housing and the first link, wherein a second pin interconnects the first link and the second link, wherein a third pin interconnects the second link, the third link and the arm, wherein a fourth pin interconnects the third link and the flag mount, and wherein a fifth pin interconnects the flag mount and the housing, with the pins being parallel to the cross bar axis.

11. A device for automatically raising a warning flag over a boat when a tow line attaches to the boat goes slack comprising:

a means for anchoring the tow line to the boat;

a means for contacting the tow line when the tow line becomes taut, with contacting means being moved from a first orientation to a second orientation when the tow line becomes taut;

a means for biasing the contacting means to the first orientation;

a mechanism for translating movement of the contacting means between the first orientation and the second orientation to movement of a flag between a raised position and a lowered position, with the mechanism mounted to a cross bar;

wherein a boat includes the cross bar defining a cross bar axis, and wherein the anchoring means anchors the tow line to the cross bar, and further wherein the contacting means is mounted to the cross bar and pivots about the cross bar axis between the first orientation and the second orientation;

wherein the mechanism for translating movement comprises:

a housing mounted to the cross bar, the housing defining an internal cavity for receiving the cross bar;

a first link having a distal end and a proximal end pivotably mounted to the housing;

a second link having a distal end and a proximal end pivotably connected to the distal end of the first link, wherein the distal end of the second link is pivotably connected to the contacting means;

a third link having a distal end and a proximal end pivotably connected to the contacting means and pivotably connected to the distal end of the second link; and a flag mount having a distal end and a proximal end pivotably mounted to the housing, wherein the flag mount has a pivot distanced from the proximal end and pivotably connected to the distal end of the third link, wherein the warning flag is connected to the distal end of the flag mount.

12. A device as recited in claim 11 wherein the contacting means comprises:

a first arm pivotably connected to the cross bar;

a second arm pivotably connected to the cross bar; and a lever rod interconnecting the first arm and the second arm, wherein the lever rod obstructs the tow line when the tow line is taut.

13. A device as recited in claim 12 wherein the lever rod includes a straight portion defining a lever axis substantially parallel to the cross bar axis and a curved portion, and wherein the lever rod is rotatable about the lever axis to selectively position the curved portion a desired distance from the boat.

14. A device as recited in claim 13 wherein the first arm and the second arm form ribbed notches for receiving the lever rod and to lock the lever rod in a selected orientation.

15. A device as recited in claim 12 wherein the biasing means comprises at least one spring, with each spring mounted between the housing and a respective arm.

16. A method for automatically raising a warning flag over a boat when a tow line attached to the boat goes slack comprising the steps of:

providing a device comprising a means for anchoring the tow line to the boat; a means for contacting the tow line when the tow line becomes taut, with the contacting means being moved from a first orientation to a second orientation when the tow line becomes taut; a means for biasing the contacting means to the first orientation; and a mechanism for translating movement of the contacting means between the first orientation and the second orientation to movement of the flag between a raised orientation and a lowered orientation, with the mechanism mounted to the cross bar anchoring the tow line to the boat;

biasing the contacting means to the first orientation;

contacting the tow line when the tow line is taut with the contacting means, wherein the contacting means is moved from the first orientation to the second orientation when the tow line is taut; and translating movement of the contacting means between the first orientation and the second orientation to movement of the flag between a raised orientation and a lowered orientation.

17. A method as recited in claim 16 further comprising the step of adjusting the position of the contacting means relative to the boat.

18. A method as recited in claim 16 wherein the tow line is anchored to a cross bar mounted on the boat, and wherein the contacting means includes a lever rod having a straight portion substantially parallel to the cross bar and a curved portion, with the curved portion contacting the tow line.

* * * * *